US005528785A

United States Patent [19]

Petrus

[11] Patent Number: 5,528,785

[45] Date of Patent: Jun. 25, 1996

[54] ATTACHABLE COUCH-CUSHION CONFINING DEVICE FOR INFANTS

[76] Inventor: Tami L. Petrus, 22804 Country Rte. 16 Parish Rd., Watertown, N.Y. 13601

[21] Appl. No.: 323,717

[22] Filed: Oct. 18, 1994

[51] Int. Cl.[6] ..... A47D 11/00; A47D 15/00

[52] U.S. Cl. ..... 5/655; 5/513; 5/93.2; 5/424; 5/427; 297/7; 297/9

[58] Field of Search ..... 5/93.1, 93.2, 94, 5/95, 425, 426, 427, 424, 655, 513; 297/7, 9

[56] References Cited

U.S. PATENT DOCUMENTS 2,676,336 4/1954 Gilmer ..... 5/94
3,844,471 10/1974 Hind ..... 5/425
4,607,402 8/1986 Pollard ..... 5/425
4,754,509 7/1988 Pollard ..... 5/425
5,233,710 8/1993 Bernard ..... 5/424
5,379,469 1/1995 Millis et al. ..... 5/95

*Primary Examiner*—Michael F. Trettel
*Attorney, Agent, or Firm*—Oblon, Spivak, McClelland, Maier & Neustadt

[57] ABSTRACT

A confining device couch converter which converts a seat cushion of a couch into a confining device for a resting baby. The confining device includes a sheet portion, which is flat, for covering a portion of the seat cushion where the baby rests. A wedge positioned along a perimeter of the sheet portion provides a barrier so that the baby does not fall onto the floor. An attaching portion connects the sheet portion to the seat cushion so that the confining device is secured to the seat cushion.

20 Claims, 3 Drawing Sheets

ATTACHABLE COUCH-CUSHION CONFINING DEVICE FOR INFANTS

BACKGROUND OF THE INVENTION

1. Field of the Invention

The present invention relates to a couch converter and, more particularly, to a confining device for infants which is attachable to a seat-cushion of a couch for converting a portion of the couch to a confining device for confining infants within a specific area on the couch.

2. Description of the Related Art

The related art consists of an ordinary couch having one or more seat cushions, removable from the main body of the couch. Generally, such a couch includes legs for supporting a main body of the couch, side arms, a backboard for propping people at an inclined position, one or more seat cushions on the main body of the couch for seating people and padding surrounding the entire exterior of the couch for comfort.

Such a common couch has been a source of comfort and enjoyment for all people throughout history. However, many people have found that they cannot enjoy their couches when they are minding an infant on the couch. Many mothers will testify that infants placed on a seat cushion of a couch must be minded at every moment. In particular, those babies which are old enough to wrestle their bodies around, but are not quite old enough to catch themselves from falling, inevitably will fall off the couch. This situation is not only extremely harrowing for parents, but may obviously result in a serious injury of the infant.

In order to prevent infants from accidently falling off the couch, many people have resorted to propping pillows in assorted arrangements on the couch as barriers between their baby and the edge of the couch. However, experienced parents agree that the method of propping pillows never works. Inevitably, a restless baby will always seem to wriggle between the pillows and fall onto the floor.

A further disadvantage of the pillow propping method is that the pillows take up more than a necessary portion of the couch. That is, other people are prevented from enjoying the couch along with the baby.

Another deficiency of the pillows is that the pillows do not cover the entire area where the baby is on the couch. If the baby should make a mess with baby food or other substances, the couch will be stained.

SUMMARY OF THE INVENTION

Until now, no invention existed which cured all of the problems of placing a baby on a couch. With the present invention, a person minding a baby on a couch does not have to pay every moment to the care of the baby and may enjoy the couch as they concentrate on more leisurely pursuits. In addition, the present invention prevents babies from seriously injuring themselves by falling off the couch. The present invention also is compact and does not take up more than a necessary portion of the couch so that others may also enjoy the couch. Also, the present invention is portable and easily stored. Finally, the present invention protects the couch from messes made by the baby.

It is an object of the present invention to convert a portion of a couch for a baby to rest in.

It is another object of the present invention to allow persons minding a baby on a couch to enjoy themselves and not have to worry constantly about the baby.

It is also an object of the present invention to prevent babies from seriously injuring themselves by falling off a couch.

It is also an object of the present invention to provide a compact confining device for a baby to rest in on a couch.

It is also an object of the present invention to prevent the couch from being stained by a baby making a mess on the couch.

It is also an object of the present invention to provide a confining device which is easily portable between couch cushions and can be easily stored and carried when not in use.

In accordance with the present invention, the foregoing objects are achieved by providing an attachable couch-cushion confining device for infants, which attaches to a seat cushion of a couch. The confining device includes a sheet portion which covers the main face of the seat cushion where the baby will primarily rest. The confining device also includes a wedge mounted on the sheet portion which forms a barrier at the edge of the couch when the confining device is mounted on a couch, thereby preventing a baby from falling off. The confining device is completed by an attaching means which is attached to one side of the confining device, loops under and around the seat cushion and connects to another side of the confining device.

In a second embodiment of the confining device, one or more side wedges are mounted on the side of the confining device for enclosing the baby between the wedges and the couch.

In a third embodiment, the sheet portion includes a skirt which covers the crack between the seat cushion and the back of the couch to prevent the baby from getting its appendages trapped between the backboard and the seat cushion.

Although the confining device is disclosed as being used with a couch, the confining device may be attached to any furniture piece having a suitable seat.

Other objects, features, and advantages of the present invention will become apparent from the following detailed description. It should be understood, however, that various changes and modifications within the spirit and scope of the invention will become apparent to those skilled in the art from this detailed description.

BRIEF DESCRIPTION OF THE DRAWINGS

A more complete appreciation of the present invention and many of the attendant advantages thereof will be readily obtained by reference to the following detailed description when considered in connection with the accompanying drawings, in which.

DESCRIPTION OF THE PREFERRED EMBODIMENTS

Figure 1A:
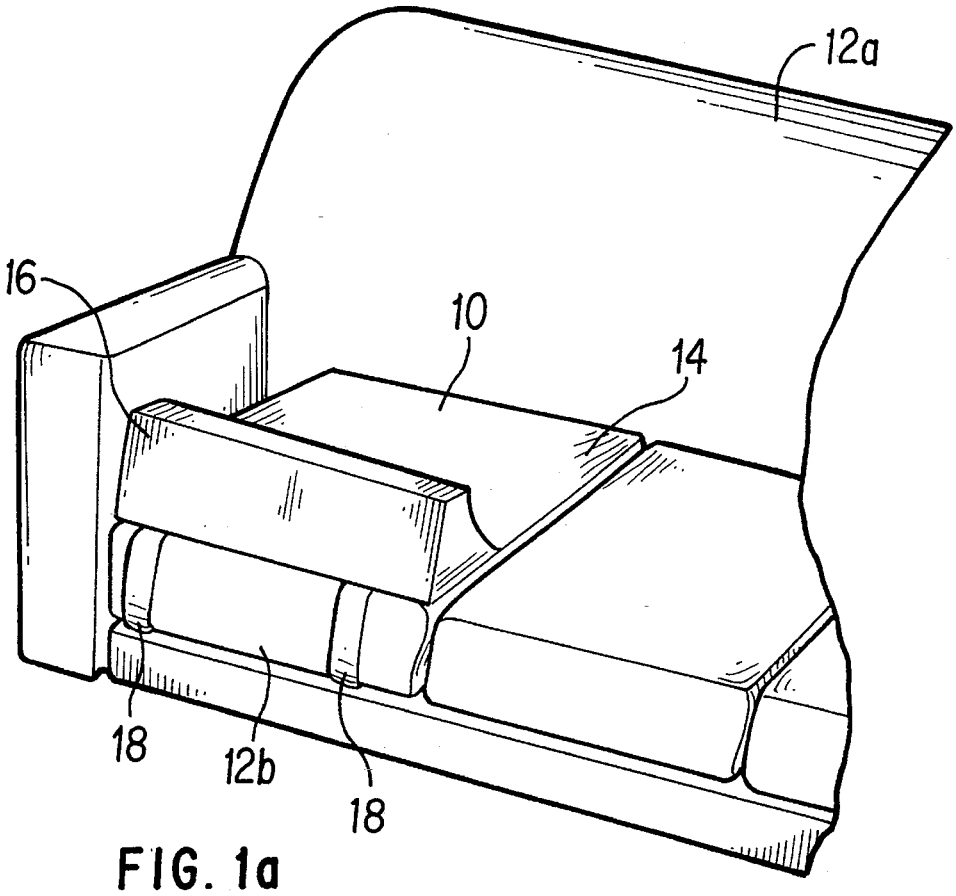
FIG. 1*a* is a perspective view of the confining device of the present invention attached to one of the cushions of a couch.
Figure 1B:
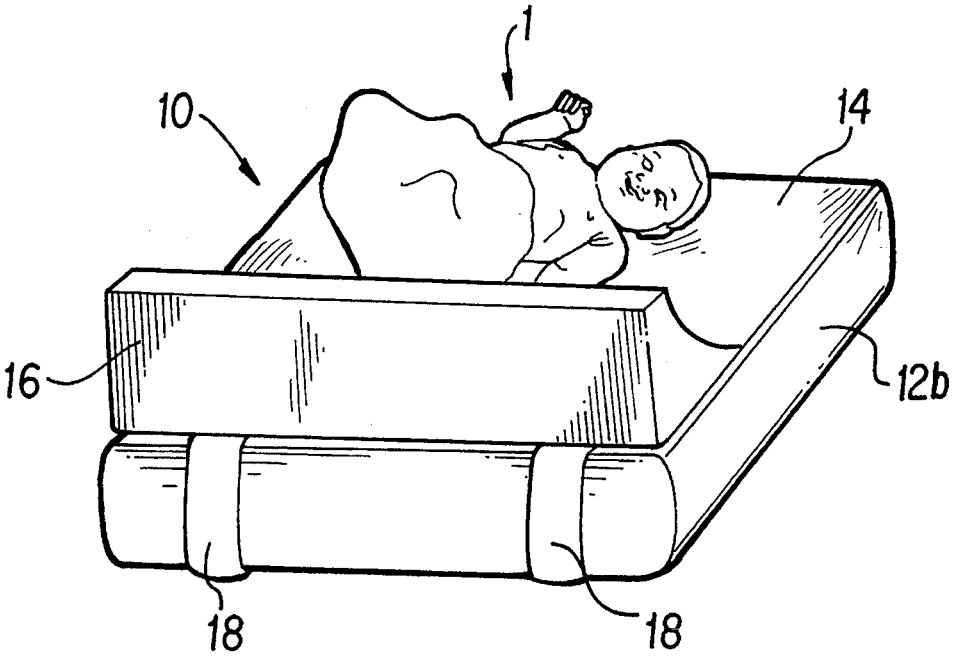
FIG. 1*b* is a perspective view of a baby resting on the confining device of FIG. 1*a*.

Referring now to the drawings, wherein like reference numerals designate identical or corresponding parts throughout the several views, the first embodiment of the present invention will be described with reference to FIGS. 1*a*, 1*b* and 2. In FIGS. 1*a* and 1*b*, a perspective view of the confining device 10 is shown attached to a seat cushion 12*b* of a couch 12*a*. As shown, a sheet portion 14 preferably covers the entire seat cushion 12*b* forming the area where the baby rests. A wedge 16 extends along a side of the confining device 10 facing the outside of the seat cushion 12*b* where a baby 1 is in danger of falling off the couch 12*a*. Attaching means 18 attach the confining device 10 to the seat cushion 12*b*.

As discussed, the sheet portion 14 preferably covers the entire area of the seat cushion 12*b* to which the confining device 10 is attached. A suitable material for the sheet portion is any material which is durable and water resistant, such as vinyl. However, consideration of comfort to the baby 1 may require that the material of the sheet portion 14 be made of softer materials such as cotton or wool. In addition, a multi-layered sheet portion 14 can be employed, such as a topsheet made of, for example, cotton and a bottom sheet made of, for example, vinyl.

The wedge 16 is mounted along an outer side of the seat cushion 12*b*, preventing the baby 1 from falling off the couch. As shown is FIG. 2, the wedge 16 preferably includes a sloped surface 17 on an inner side of the wedge 16 to provide a comfortable transition of the confining device 10 for the baby 1 to lean on. Preferably, the exterior of the wedge 16 is made from the same continuous material that the sheet portion 14 is made of and forms a receptacle for a foam shaped wedge (not shown). Any foam material which provides sufficient comfort yet is durable enough to provide a barrier to a baby 1 is suitable.

Attaching means 18 attaches the confining device 10 firmly to the seat cushion 12*b* so that a restless baby 1 will not displace the confining device 10 and allow an opening for the baby to fall off the couch 12*a*. Preferably, the attaching means 18 includes adjustable straps attached at one side of the confining device 10 which loop under the seat cushion 12*b* and attach to another side of the confining device 10. The attaching means 18 may attach to the confining device 10 using any suitable fasteners, such as hooks, loops and friction fasteners (Velcro™) etc. The attaching means may also be in the form of elastic straps. FIG. 2 shows that the attaching means 18 is attached from the outer side of the confining device 10, loops under the seat cushion 12*b* and attaches to an opposite side of the confining device 10 at 18*a* by utilizing any of the fasteners discussed above. However, the attaching means 18 can attach to any side of the confining device 10 and does not have to loop under the seat cushion. As shown in FIG. 2, the attaching means 18 is fixed to the wedge 16 and is movably attached to an area of the sheet portion 14 on an opposite side of the surface facing the baby 1 so that the baby 1 is not accidentally harmed or accidentally releases the fasteners.

Figure 2:
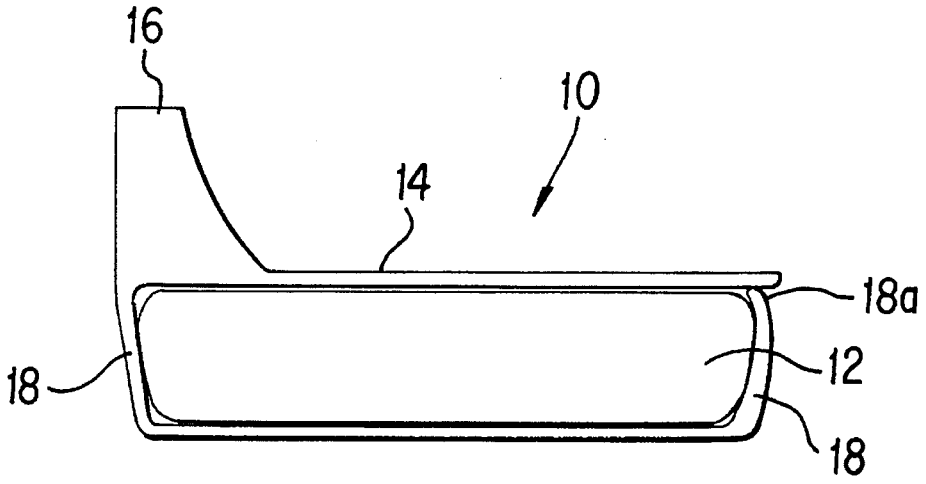
FIG. 2 is a plan view of a side of the confining device attached to the seat cushion.

With the invention of the embodiment of FIGS. 1*a*, 1*b* and 2, a person minding a baby 1 may place the baby 1 without worry within the confines of the confining device 10. The soft sheet portion 14 will prevent baby 1 from coming into contact with the seat cushion 12*b* of the couch 12*a* for both the baby's 1 and the couch's 12*a* benefit. The wedge 16 will prevent the baby 1 from falling off the couch 12*a*. Moreover, the confining device 10 will not be displaced because the attaching means 18 firmly attaches the confining device 10 to the seat cushion 12*b*.

When a baby 1 is resting in the confining device 10, the baby's 1 own weight prevents the baby 1 from displacing the confining device 10 from the seat cushion 12*b*. When the baby 1 is removed, the confining device 10 can be easily detached from the seat cushion 12*b* by simply detaching the attaching means 18. Similarly, the confining device. 10 can be easily attached to any other seat cushion by refastening the attaching means 18 on another seat cushion. Therefore, the confining device 10 is easy to use and is portable.

Moreover, the confining device is preferably made mostly of cloth materials and is easily stored and carried simply by folding or rolling the confining device. Carriages and portable cribs, which must include a hard plastic shell, cannot be collapsed or rolled and must be lugged around by a weary parent. The confining device, however, can be neatly folded or rolled and stored easily in a hand bag, allowing a caretaker of the infant to have more freedom of movement.

Another advantage of the confining device 10 is that a baby 1 can be transported to other areas while resting on the confining device 10. Instead of detaching the confining device from seat cushion 12*b* and re-attaching the confining device 10 to a different seat cushion, a person may simply exchange seat cushion 12*b* along with baby 1 with any other seat cushion of the couch 12*a*. Thus, anyone wishing to use the couch 12*a* can sit wherever they desire simply by exchanging baby 1 along with the confining device 10 and seat cushion 12*b* with another seat cushion without having to detach and reattach the confining device 10.

Figure 3:
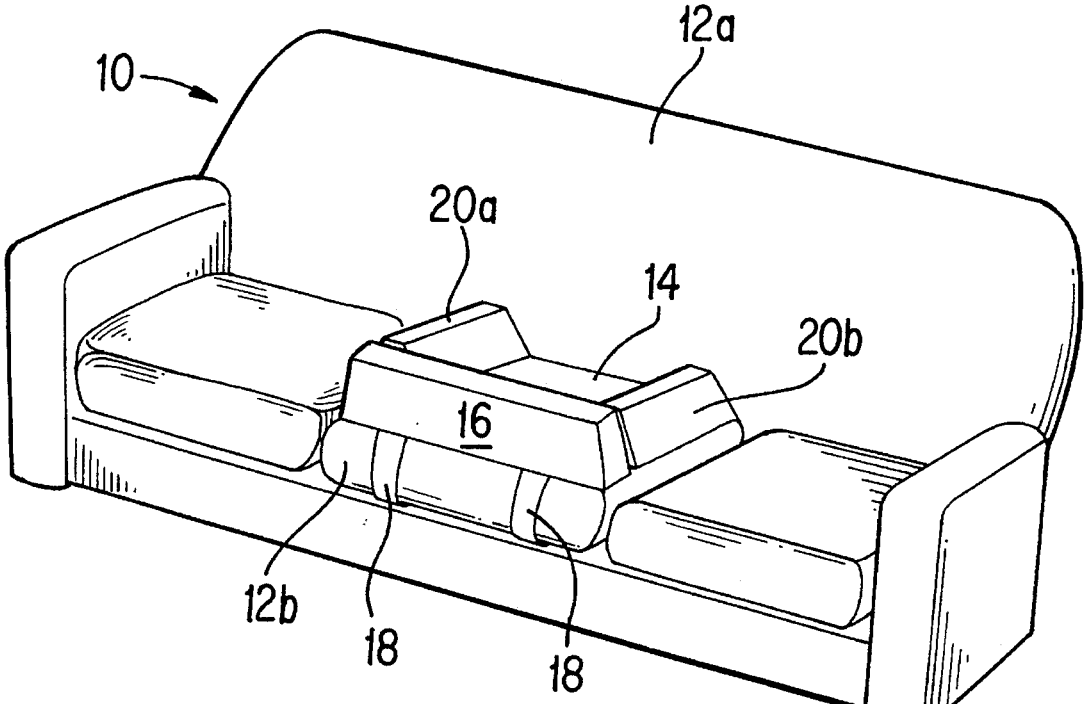
FIG. 3 shows a perspective view of the second embodiment of the confining device including one or more side wedges for completely surrounding the baby between the confining device and the couch.

The second embodiment of the present invention is shown in FIG. 3, wherein the confining device 10 further includes one or more side wedges 20*a* and 20*b*. The side wedges. 20*a* and 20*b* are preferably comprised of the same structure and material that wedge 16 is comprised. Side wedge 20*a* and 20*b* prevent a baby from moving out of the confines of the confining device 10 from either side when a central seat cushion of the couch 12*a* is employed. In this embodiment, a baby 1 is totally confined within the area of a confining device 10 and there is no danger that the baby 1 will fall off the couch 12*a*.

In any of the embodiments, some or all of the wedges 16, 20*a* and 20*b* may be fixed or detachably mounted on the confining device 10. With the wedges 16, 20*a* and 20*b* detachable, a caretaker can selectively add or remove any of the wedges 16, 20*a* and 20*b* as desired. The wedges 16, 20*a* and 20*b* may be detachably mounted using friction fasteners, zippers, or any suitable means for detachable mounting. As a further embodiment, the wedges 16, 20*a* and 20*b* can be in the form of a single continuous wedge.

Figure 4:
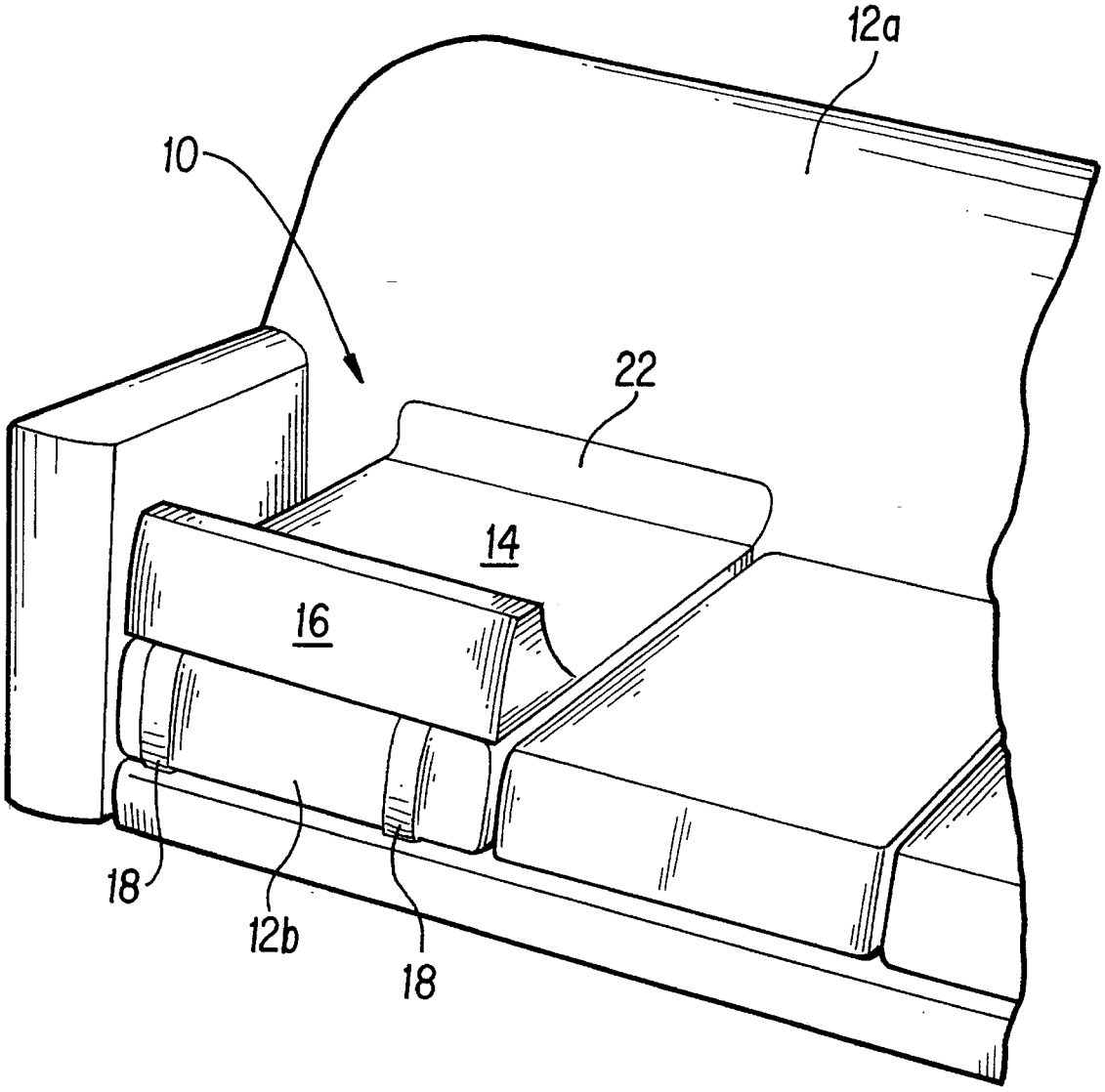
FIG. 4 is a perspective view of a third embodiment of the confining device showing a skirt covering the crack between the back-board of the couch and the seat cushion.

The third embodiment shown in FIG. 4, includes a skirt 22 which is connected to the sheet portion 14 and covers a crack (not shown) between the back-board of the couch 12*a* and a seat cushion 12*b*. In this embodiment, appendages of the baby 1, including the head, are prevented from being caught in this crack in the couch 12*a* which may result in suffocation of the baby. The skirt 22 may be one continuous part of the sheet portion 14 or may be a detachable section.

With the above embodiments, one minding a baby 1 need not worry that the baby 1 will fall off the couch 12*a*. The confining device 10 is easy to use, portable and protects the couch 12*a* from stains.

Obviously, numerous modifications and variations of the present invention are possible in light of the above teachings. It is therefore, to be understood that within the scope of the pending claims, the invention may be practiced otherwise than as specifically described herein.

What is claimed as new and is desired to be secured by letters patent of the United States is:

1. A confining device for infants attachable to a seat cushion of a furniture piece, comprising:

a sheet portion being flat for covering a portion of the seat cushion where the infant rests;

a wedge mounted along a first perimeter of the sheet portion for providing a barrier to the infant; and an attaching portion for connecting the sheet portion to the seat cushion;

wherein the attaching portion attaches to a first side of the sheet portion, loops under the seat cushion and attaches to a second side of the sheet portion.

2. The confining device according to claim 1, wherein the attaching portion further comprises:

an adjustable strap for adjusting a tightness of the attaching portion around the seat cushion.

3. The confining device according to claim 1, wherein the attaching portion further comprises:

loop and hook fasteners for quickly connecting the confining device to the seat cushion.

4. The confining device according to claim 1, further comprising:

a side wedge mounted to the sheet portion along a second perimeter of the sheet portion for preventing the infant from getting out of the confining device.

5. The confining device according to claim 1, wherein the wedge further comprises:

a sloped portion on an inner side of the wedge for providing a transitional surface for the infant to rest against.

6. A confining device for infants attachable to a seat cushion of a couch, the seat cushion having a rectangular, main surface for sitting on and having an outer side where the furniture piece ends and a drop-off between the furniture piece and the floor begins, the confining device comprising:

a rectangular sheet portion for providing a comfortable resting area for the infant;

a wedge being elongated and mounted along a first perimeter of the sheet portion for providing a barrier to the infant across an entire side of the rectangular sheet portion; and an elongated attaching portion attached to a side of the sheet portion;

wherein the confining device is attached to the seat cushion by placing the sheet portion on the main surface of the sheet cushion with the wedge positioned along a side of the seat cushion and looping the attaching portion underneath the seat cushion;

wherein the attaching portion attaches to a first side of the sheet portion, loops under the seat cushion and attaches to a second side of the sheet portion.

7. The confining device according to claim 6, wherein the attaching portion further comprises:

an adjustable strap for adjusting a tightness of the attaching portion around the seat cushion.

8. The confining device according to claim 6, wherein the attaching portion further comprises:

loop and hook fasteners for quickly connecting the confining device to the seat cushion.

9. The confining device according to claim 6, further comprising:

a side wedge mounted to the sheet portion along a second perimeter of the sheet portion for preventing the infant from getting out of the confining device.

10. The confining device according to claim 6, wherein the wedge further comprises:

a sloped portion on an inner side of the wedge for providing a transitional surface for the infant to rest against.

11. A confining device for infants attachable to a seat cushion of a furniture piece, comprising:

a sheet portion being flat for covering a portion of the seat cushion where the infant rests;

a wedge mounted along a first perimeter of the sheet portion for providing a barrier to the infant; and attaching means for connecting the sheet portion to the seat cushion;

wherein the attaching means attaches to a first side of the sheet portion, loops under the seat cushion and attaches to a second side of the sheet portion.

12. The confining device according to claim 11, wherein the attaching means further comprises:

an adjustable strap for adjusting a tightness of the attaching means around the seat cushion.

13. The confining device according to claim 11, wherein the attaching means further comprises:

loop and hook fasteners for quickly connecting the confining device to the seat cushion.

14. The confining device according to claim 11, further comprising:

a side wedge mounted to the sheet portion along a second perimeter of the sheet portion for preventing the infant from getting out of the confining device.

15. The confining device according to claim 14, wherein the side wedge is detachable.

16. The confining device according to claim 11, wherein the wedge further comprises:

a sloped portion on an inner side of the wedge for providing a transitional surface for the infant to rest against.

17. The confining device according to claim 11, wherein the wedge is detachable.

18. A confining device for infants attachable to a seat cushion of a furniture piece, comprising:

a sheet portion being flat for covering a portion of the seat cushion where the infant rests;

a wedge mounted along a first perimeter of the sheet portion for providing a barrier to the infant; and an attaching portion for connecting the sheet portion to the seat cushion;

wherein the wedge further comprises:

a sloped portion on an inner side of the wedge for providing a transitional surface for the infant to rest against.

19. A confining device for infants attachable to a seat cushion of a couch, the seat cushion having a rectangular, main surface for sitting on and having an outer side where the furniture piece ends and a drop-off between the furniture piece and the floor begins, the confining device comprising:

a rectangular sheet portion for providing a comfortable resting area for the infant;

a wedge being elongated and mounted along a first perimeter of the sheet portion for providing a barrier to the infant across an entire side of the rectangular sheet portion; and an elongated attaching portion attached to a side of the sheet portion;

wherein the confining device is attached to the seat cushion by placing the sheet portion on the main surface of the sheet cushion with the wedge positioned along a side of the seat cushion and looping the attaching portion underneath the seat cushion;

wherein the wedge further comprises:

a sloped portion on an inner side of the wedge for providing a transitional surface for the infant to rest against.

20. A confining device for infants attachable to a seat cushion of a furniture piece, comprising:

a sheet portion being flat for covering a portion of the seat cushion where the infant rests;

a wedge mounted along a first perimeter of the sheet portion for providing a barrier to the infant; and attaching means for connecting the sheet portion to the seat cushion;

wherein the wedge further comprises:

a sloped portion on an inner side of the wedge for providing a transitional surface for the infant to rest against.

* * * * *